US005397860A

United States Patent [19]

Yochum et al.

[11] Patent Number: 5,397,860

[45] Date of Patent: Mar. 14, 1995

[54] MULTIPLE-CORE ELECTRICAL IGNITION SYSTEM CABLE

[75] Inventors: Edwin L. Yochum; Richard H. Olson, both of Plymouth, Ind.

[73] Assignee: SplitFire, Inc., Northbrook, Ill.

[21] Appl. No.: 145,980

[22] Filed: Oct. 29, 1993

[51] Int. Cl.[6] ..... H01C 3/06; H01B 7/00

[52] U.S. Cl. ..... 174/113 C; 174/35 SM; 174/120 R; 174/120 SC; 174/131 A; 338/214

[58] Field of Search ..... 174/113 C, 131 A, 355 M, 174/114 R, 120 R, 120 C, 120 SC; 338/214

[56] References Cited

U.S. PATENT DOCUMENTS

| | | | |
|---|---|---|---|
| 534,596 | 2/1895 | Atwood et al. . | |
| 2,131,066 | 9/1938 | Obermaier | 201/63 |
| 2,185,944 | 1/1940 | Holmes | 200/143 |
| 2,433,081 | 12/1947 | Wilkoff | 174/35 SM |
| 2,438,006 | 3/1948 | Gustafson | 174/112 |
| 2,577,077 | 12/1951 | Forsberg | 174/101.5 |
| 3,040,284 | 6/1962 | Connell | 339/61 |
| 3,603,715 | 9/1971 | Eilhardt et al. | 174/15 |
| 3,680,027 | 7/1972 | Vitale | 174/120 SC |
| 3,683,309 | 8/1972 | Hirose | 338/214 |
| 3,894,172 | 7/1975 | Jachimowicz et al. | 174/34 |
| 4,434,320 | 2/1984 | Klein et al. | 174/23 |
| 4,514,712 | 4/1985 | McDougal | 336/96 |
| 4,683,349 | 7/1987 | Takebe | 174/113 C |
| 4,700,171 | 10/1987 | Coffey et al. | 174/120 SC |
| 4,800,359 | 1/1989 | Yukawa et al. | 338/214 |
| 4,894,490 | 1/1990 | Fujimoto | 174/131 A |
| 5,059,938 | 10/1991 | Brown | 338/214 |
| 5,061,821 | 10/1991 | Nercessian | 174/34 |

FOREIGN PATENT DOCUMENTS

| | | | |
|---|---|---|---|
| 2023328 | 12/1979 | United Kingdom | 174/113 C |

*Primary Examiner*—Morris H. Nimmo

*Attorney, Agent, or Firm*—Whyte Hirschboeck Dudek

[57] ABSTRACT

A failure-resistant electrical ignition system cable comprises first and second terminal contacts for contacting a source of ignition pulses and contacting the predetermined destination of these pulses, respectively; a plurality of flexible ignition conductors connected between the first and second terminal contacts, each of the ignition conductors being capable of electrically communicating the ignition pulses between the terminal contacts, each of the ignition conductors comprising an electrically-inert center, an elongated conductive wire spirally and interstitially wound around the center for substantially the full length thereof, each of the ignition conductors then being twisted about each other so as to provide repeated electrical contacts of the conductive wire of each whereby electrical continuity between the terminal contacts may be maintained despite the occurrence of one or more electrical discontinuities; the outer exposed surfaces of the twisted ignition conductors being electrically insulated by a flexible insulating medium. The cable may optionally include a concentric reenforcing braid intermediate the ignition conductors and the outer surface of the ignition system cable.

20 Claims, 2 Drawing Sheets

MULTIPLE-CORE ELECTRICAL IGNITION SYSTEM CABLE

BACKGROUND OF THE INVENTION

1. Field of the Invention

This invention relates to cables for a variety of electrical ignition systems. Specifically, it relates to improved electrical-pulse-carrying cables having electromagnetic-radiation-suppression characteristics which can be efficiently manufactured using conventional techniques, are failure resistant and otherwise have enhanced operating characteristics. While the present invention will be described primarily in connection with its applicability to automotive ignition systems, it is not limited thereto as those skilled in the art will readily recognize.

2. Discussion of the Prior Art

Electrical cables for carrying pulsating currents must meet a number of requirements, sometimes conflicting, including the reliable delivery of the electrical pulse from where it is generated, e.g., the ignition coil of a car, to where it is employed, e.g., the spark plug of an internal combustion engine. As has been long recognized, however, the electromagnetic field generated by the electrical pulses must be suppressed so as not to interfere with other commonly encountered electronic devices, including, for example, radio and telephone communication systems, but particularly on-board automotive devices.

Prior-art electromagnetic suppression cables have successfully coped with the electromagnetic radiation problem but occasional breaks in the lengthy spirally-wound metal conductors employed in many of such cables due to deterioration, fatigue, vibration, mechanical stress or the like may lead to cable failure or unshielded sparking or both. Thus, a cable may fail to perform its basic function of conducting the electrical pulse, or such conduction may be accompanied by unacceptable electromagnetic interference. In the case of an automotive ignition cable, a break in the wire may result in the failure of the spark plug to fire, rendering the associated cylinder inoperative, or unsuppressed sparking, resulting in undesired interference, as those skilled in the art are fully aware.

Periodic routine checking of prior art ignition cables having suppression characteristics will not necessarily reveal a potential for incipient wire failure. As a result, in the case of motor vehicles, the first sign of wire failure may be cylinder-firing disruption or failure or excessive electromagnetic interference. Such failures may occur at inconvenient times or inconvenient locations, resulting in unscheduled costly and untimely maintenance requirements.

OBJECTS OF THE INVENTION

It is therefore a general object of the present invention to cope with these shortcomings of prior-art ignition cables.

It is another general object to provide an improved ignition system cable having enhanced failure resistance.

It is another object to provide an ignition cable having electromagnetic suppression characteristics which will continue to perform satisfactorily even in the event of wire discontinuity, including multiple discontinuities.

It is another object to provide an ignition cable of improved reliability which can be routinely checked for incipient failure prior to inoperativeness or loss of electromagnetic suppression characteristics.

It is a specific object of the present invention to provide an ignition cable of superior strength without undue sacrifice of flexibility, including multiplane flexibility, which cable also appears like prior-art cables so as not to cause undue concern or puzzlement by unskilled installers.

It is still another object to provide an improved ignition cable which lends itself to manufacture by conventional techniques, may be employed with conventional end connectors and can be installed and employed in the same manner as prior-art ignition cables.

These and other objects of the present invention will become apparent from the description hereinafter set forth.

SUMMARY OF THE INVENTION

These objects are achieved by a multiple-core electrical ignition system wherein the multiple cores are disposed in such a manner as to assure continued acceptable performance despite the existence of one or more discontinuities in the conductive wires employed therein. The improved failure-resistant electrical system cable comprises first and second terminal contacts for electrically-contacting both a source of ignition pulses and the predetermined destination thereof, respectively. A plurality of flexible ignition conductors are connected between the first and second terminal contacts and are disposed with respect to each other to achieve greater reliability than merely two parallel paths, as hereinafter set forth.

Each of the ignition conductors are individually capable of electrically communicating the ignition pulses between the first and second terminal contacts, and each has electromagnetic-radiation-suppression characteristics. Each of the ignition conductors comprises an electrically-inert center and an elongated conductive wire spirally and interstitially wound around the center for substantially the full length so as to provide a continuous electrical path for electrically communicating the ignition pulses between the first and second terminal contacts. As will be apparent to those skilled in the art, the combination of the spiral winding and inherent electrical resistance of the elongated conductive wire is designed to impart desired electromagnetic-suppression characteristics to the ignition conductors.

To achieve a level of reliability greater than that associated with simply having a plurality of flexible ignition conductors disposed in parallel relationship between the first and second terminal contacts, each of the ignition conductors are generally-helically twisted about each other so as to provide at least repeated, if not continuous, electrical contact of the elongated conductive wire of each with each other along the respective lengths of each. This greatly enhances the probability of electrical continuity between the terminal contacts despite the undesired occurrence of one or more electrical discontinuities along the elongated conductive wire of one or more of the ignition conductors.

As is apparent, electrical discontinuities or breaks in the spirally-wound conductive wire of all of the ignition conductors will not necessarily cause electrical failure of the cable unless such breaks unlikely occur at the same electrical locations along each of the conductive wires. Moreover, absent such total failure, the presence of breaks in any of the conductive wires can be detected by changes in the resistance between the terminal contacts. Each of the wires are in electrical parallel relationship with the others and any break in one of them would increase the measured resistance between the terminal contacts. Thus, the potential problem can be detected and remedied (typically by replacement of the cable) during routine maintenance checks. In contrast, prior art cables give no such early warning, the first indication being failure of conduction or failure of electromagnetic suppression, often in situations where such failures can not be readily remedied.

The helically-twisted ignition conductors are, of course, somewhat longer than the single conductor of prior-art ignition cables of comparable length. The twisted disposition provides longitudinal resilience to the conductor (and thus less tendency to rupture), in addition to the aforesaid advantage of greater electrical integrity. The helical twisting of the wires also has the advantageous result of a combination which is flexible in all planes, in contrast to a non-twisted combination of parallel conductors having single-plane or otherwise limited flexibility.

Between the terminal contacts the twisted ignition conductors of the present invention are enclosed within a flexible insulating medium which electrically insulates the outer exposed surfaces of the twisted ignition conductors substantially the full length thereof. In practice, the flexible insulating medium is extruded around the ignition conductors. This results in a unitary ignition system cable of essentially conventional exterior appearance but of greater reliability.

The flexible insulating medium may be opaque and of any desired color. The flexible insulating medium may optionally be translucent or transparent so that the plurality of helically-twisted ignition conductors is visible. This may be advantageous in readily identifying the type of cable to the purchaser or installer. Color coding of the conductors may also enhance appearance and marketability.

An attribute of the present invention is the fact that each of the plurality of ignition conductors may be of essentially conventional design whereby they lend themselves to conventional manufacturing techniques. While as many as three or more of the flexible ignition conductors can be employed in the practice of the present invention, only two are required in the presently-preferred automotive spark plug cable embodiment.

As indicated, each of the ignition conductors may be of conventional design, that is, the single ignition conductor of prior-art cables. In a preferred embodiment, each comprises an electrically-inert center comprising, for example, elongated strands of fiberglass or Kevlar (a DuPont aramid fiber), or a combination of both. The Kevlar enhances the strength of the center and thus the cable as a whole. In the automotive spark plug cable embodiment, such inert core may be generally circular in cross section, typically having a diameter of about 0.02" to 0.10", e.g., about 0.05".

The elongated conductive wire which is spirally and interstitially wound around the electrically-inert center, typically about 50–150 spirals per inch, may comprise, for example, stainless steel or nickel-copper alloy, which are well known to those skilled in the art. In a specific automotive spark plug cable embodiment the wire may typically comprise 403 stainless steel wire having a diameter corresponding to about 39 AWG.

In a preferred embodiment, the conductive wire of at least one of said ignition conductors is at least partially and preferably completely coated with a conductive acrylic or conductive latex. Such coating tends to cement the conductive wire into place around the inert center during further steps in the manufacturing process. Typically, the conductivity of the acrylic or latex coating is provided by the carbon black content thereof whereby the coating can become part of the electrical circuit, if need be. The coating may optionally contain ingredients which assist during manufacture in terminating the cable, e.g., during cutting and stripping of the insulation. Each conductor typically has a diameter in the range of about 0.025" to 0.140", e.g., about 0.060.

The helical twisting of each of the conductors about each other is an essential element of the present invention. In the automotive ignition cable embodiment, the twists number about 5 to 25 per foot, e.g., about 10 to 20 per foot, preferably about 15.

The outer insulating material may also be of conventional origin. In a preferred embodiment, silicon rubber or EPDM (Ethylene Propylene Diene Monomer) insulating material may be employed. The diameter of the resulting insulated cable is typically in the range of about 0.20" to 0.40", e.g., about 0.32".

In another preferred embodiment of the present invention a concentric reinforcing braid, e.g., braided fiberglass or equivalent, is employed intermediate the plurality of flexible ignition conductors and the outer surface. This embodiment is described, in further detail in connection with the drawings.

BRIEF DESCRIPTION OF THE DRAWINGS

The present invention may be more clearly understood from the following description of a specific and preferred embodiment read in conjunction with the accompanying drawings, wherein.

It should be recognized that because certain elements depicted in these drawings differ so substantially in actual size, the relative dimensions may not necessarily be to the same scale. Any such apparent inconsistencies assist, however, in readily portraying and understanding the present invention.

DETAILED DESCRIPTION OF THE DRAWINGS

Figure 1:
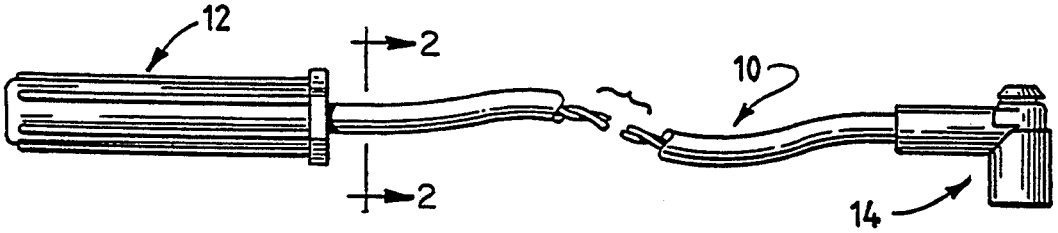
FIG. 1 is an overall view, partially cutaway, of a preferred embodiment of the present invention employed as a part of a spark plug ignition cable.

Referring to FIG. 1, the preferred embodiment of the ignition system cable of the present invention comprises cable portion 10 having first and second terminal contacts (not shown) at the left and right extremities, as viewed in FIG. 1. These contacts are housed within the ignition coil connector insulator 12 and spark plug connector insulator 14, both of which may be of conventional design well known to those skilled in the art.

Typically, cable portion 10 may have a length between connector insulators 12 and 14 of less than a foot to several feet or more. Connector insulators 12 and 14 comprise rubber or rubber-like protective insulation which is shaped and otherwise designed to perform the insulation function and maintain the integrity of the connection in the particular ignition system in which it is employed.

The cutaway portions adjacent the center of FIG. 1 show a plurality of flexible ignition conductors adjacent the center which are two in number in the illustrated embodiment. The invention, however, is not necessarily limited thereto. Details of these ignition conductors are discussed in connection with FIGS. 2 and 3.

Figure 2:
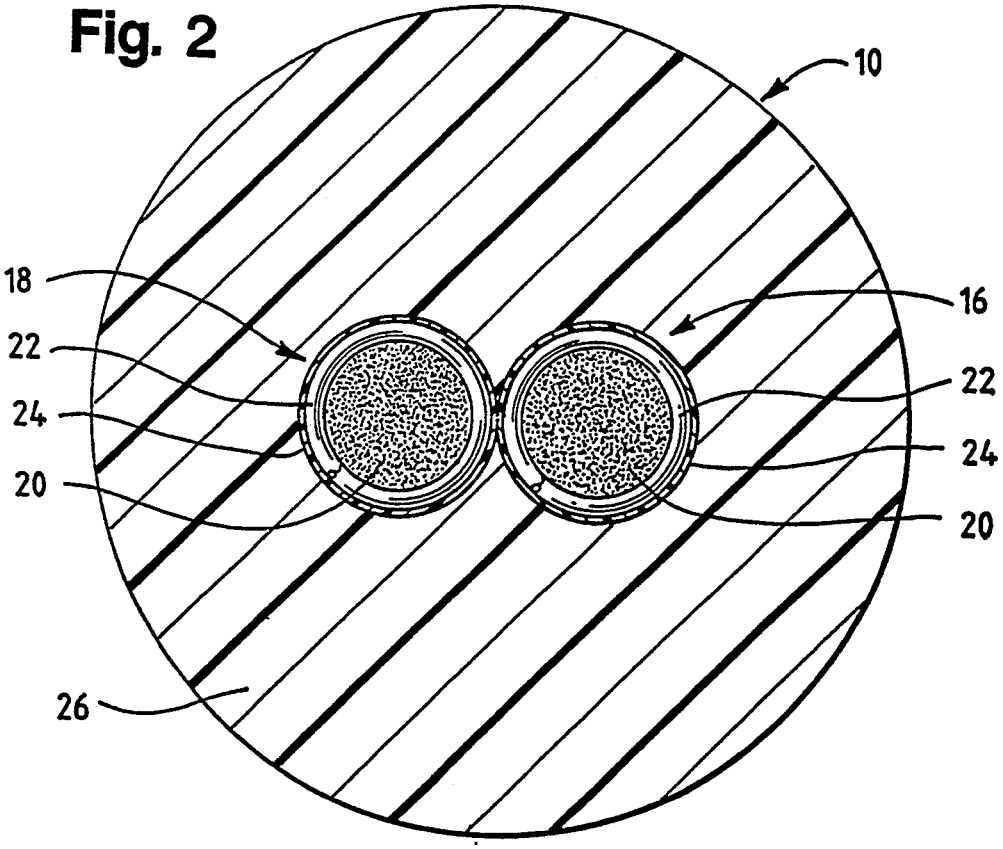
FIG. 2 is a highly-magnified cross-sectional view taken along the line 2—2 of FIG. 1.

Referring to the highly-magnified cross-sectional view of FIG. 2, electrical ignition system cable 10 comprises flexible ignition conductors 16 and 18, which in the illustrated embodiment are identical but need not be. They comprise inert core 20 comprising a multiplicity of elongated strands of glass and Kevlar fibers, the particular size and configuration thereof being well known to those skilled in the art. While the cross-sectional configuration of the electrically-inert center is shown as circular, such cross section may vary somewhat depending upon the manufacturing technique, whether the conductor is flexed, and the like.

Spirally and interstitially wound around the inert center 20 is an elongated conductive wire 22. Each of these wires 22 is sized so as to be individually electrically capable of communicating the ignition pulses to be carried by the wire.

Figure 3:
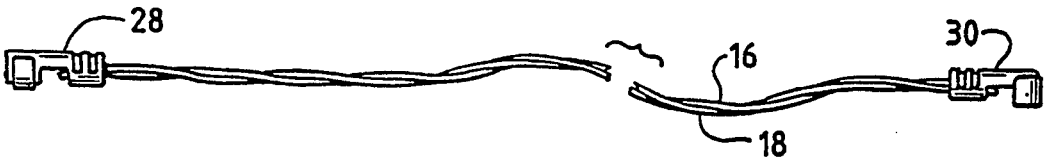
FIG. 3 is a view of the ignition conductors of the present invention with the opaque flexible insulation medium and the connector insulators of FIG. 1 removed therefrom, and illustrating the helically-twisted disposition of the ignition conductors between the terminal contacts.

As will be apparent from FIG. 3, the flexible ignition conductors 16 and 18 are helically twisted about each other whereby wires 22 are in repeated or substantially continuous electrical contact along the respective lengths of each. In the embodiment of FIG. 2, however, wire 22 of conductors 16 and 18 are coated, continuously or at least partially with an electrically-conductive coating 24. This coating tends to stabilize the positioning of conductors 16 and 18 and may be formulated to otherwise assist in the manufacture of the cable particularly when attaching terminal contacts thereto.

In a particular embodiment, coating 24 comprises a conductive acrylic or a conductive latex or equivalent. Limited conductivity thereof is imparted by its carbon black content or other suitable material. While the inherent resistivity of the coating may be greater than the underlying wire, the conductivity is more than sufficient to establish a conductive path between the wires 22 in the event of a break or breaks therein or substantial increase in resistance thereof due to wire deterioration, partial rupture or the like. Accordingly, while spirally wound wires 22 are in electrical parallel relationship, they in effect provide a multiplicity of cross paths between each other throughout their entire length.

In effect, the twisting of the conductors can be considered a "safety twist". As already indicated, this assures that electrical integrity is maintained despite one or more breaks in either or both of wires 22. Should portions of wires 22 be electrically segregated by breaks, the presence of such breaks may be detected by changes (increases) in resistance between the contacts during routine maintenance checks.

Conductors 16 and 18 are housed in a flexible medium 26 to insulate and protect the conductors and otherwise impart an attractive and user-friendly appearance and configuration thereto. As already indicated, flexible insulating medium 26 may comprise a silicon rubber, EPDM insulating material or equivalent, which is preferably added by extrusion techniques. In the embodiment of the drawings the flexible insulating medium 26 is opaque; optionally, it may be transparent or translucent, as already indicated.

Referring to FIG. 3, wires 16 and 18 are helically twisted along their entire length between ignition coil contact 28 and spark plug contact 30 which are housed within connector insulators 12 and 14 (FIG. 1), respectively. As with connector insulators 12 and 14, the configuration of contacts 28 and 30 may be of conventional design to match the particular installation requirements.

Figure 4:
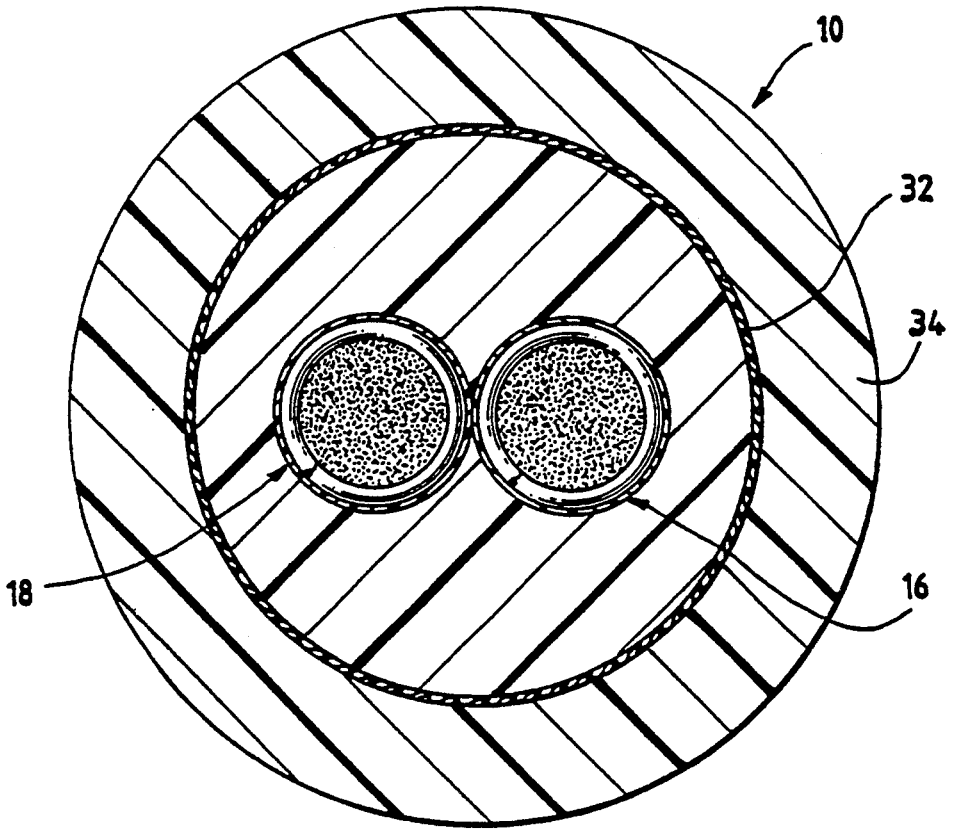
FIG. 4 is a highly-magnified cross-sectional view similar to that of FIG. 2 showing an alternative embodiment, including a reinforcing braid and other flexible jacket or sheath.

Referring to the reinforced embodiment of FIG. 4, the flexible ignition conductors 16 and 18 and flexible insulating medium 26 are substantially the same as in FIG. 2. Insulating medium 26, however, is radially narrower and is encased in a concentric, annular reenforcing braid 32 of suitable flexible material, e.g., braided fiberglass or other strengthening equivalent. A protective outer annular jacket or sheath 34 of flexible insulating material provides the external surface of cable 10. As those skilled in the art will recognize, the outer annular jacket may also be added by extrusion techniques, resulting in a plurality of extrusion steps.

Sheath 34 may comprise the same flexible insulating material as medium 26, e.g., silicon rubber, EPDM or equivalent polymeric material. It may, however, comprise other suitable media having desired physical and aesthetic properties. If sheath 34 and medium 26 comprise the same flexible material, the cables of FIGS. 2 and 4 are in effect identical except for the presence of reinforcing braid 32.

As is apparent from the above description, the failure-resistant electrical ignition system cable of the present invention copes with shortcomings of prior art cables and provides greater reliability and performance without necessitating the use of costly or experimental materials or manufacturing techniques. It achieves various objects of the present invention as previously set forth.

Actual viewing of the resulting spark produced by the cable of the present invention under laboratory conditions also reveals a superior-appearing spark as compared with prior-art single-conductor cables. Such apparent superiority is presently unexplained and whether it results in superior ignition performance of systems activated or controlled thereby under actual operating conditions is being determined.

It is to be understood that any allowed claims based on this application are to be accorded a range of equivalents commensurate in scope with the advance over the prior art.

Having described in the invention, what is claimed is:

1. A failure-resistant electrical ignition system cable comprising:

(a) a first terminal contact for electrically-contacting a source of ignition pulses;

(b) a second terminal contact for electrically contacting the predetermined destination of said ignition pulses;

(c) a plurality of flexible ignition conductors connected between said first and said second terminal contacts, (i) each of said ignition conductors being individually capable of electrically-communicating said ignition pulses between said first and said second terminal contacts and having electromagnetic-radiation-suppression characteristics, (ii) each of said ignition conductors comprising an electrically-inert center and an elongated conductive wire spirally and interstitially wound around said center for substantially the full length thereof so as to provide a continuous electrical path for electrically-communicating said ignition pulses between said first and said second terminal contacts, (iii) each of said ignition conductors being generally-helically twisted about each other so as to provide at least repeated electrical contacts of the elongated conductive wire of each with each other along the respective lengths of each, whereby electrical continuity between said terminal contacts may be maintained despite the occurrence of one or more electrical discontinuities along the elongated conductive wire of one or more of said ignition conductors; and (d) a flexible insulating medium electrically insulating the outer exposed surfaces of the twisted ignition conductors substantially the full length thereof between said first and said second terminal contacts to form a unitary ignition system cable.

2. The ignition system cable of claim 1, wherein the elongated conductive wire of at least one of said ignition conductors is at least partially coated with an electrically-conductible coating.

3. The ignition system cable of claim 2, wherein said electrically-conductible coating comprises a conductive latex.

4. The ignition system cable of claim 1, wherein the electrically-inert centers of said ignition conductors comprises elongated strands of glass fibers and Kevlar fibers.

5. The ignition system cable of claim 1, wherein said elongated conductive wire comprises stainless steel wire.

6. The ignition system cable of claim 1, wherein said flexible insulating medium comprises EPDM.

7. The ignition system cable of claim 1, wherein said flexible insulating medium comprises silicon rubber.

8. The ignition system cable of claim 1, wherein said flexible insulating medium has sufficient light transmissibility to reveal the helically-twisted ignition conductors to the viewer.

9. The ignition system cable of claim 1 including a concentric reenforcing braid intermediate said ignition conductors and the exposed surface of said ignition system cable.

10. The ignition system cable of claim 9 wherein said reenforcing braid comprises braided fiberglass.

11. The ignition system cable of claim 9 including an annular sheath of flexible insulation exterior to said reenforcing braid.

12. The ignition system cable of claim 11 wherein said annular sheath and said flexible insulating medium have the same composition.

13. A failure-resistant electrical ignition system cable comprising:

(a) a first terminal contact for electrically-contacting a source of ignition pulses;

(b) a second terminal contact for electrically contacting the predetermined destination of said ignition pulses;

(c) a plurality of flexible ignition conductors connected between said first and said second terminal contacts, (i) each of said ignition conductors being individually capable of electrically-communicating said ignition pulses between said first and said second terminal contacts and having electromagnetic-radiation-suppression characteristics, (ii) each of said ignition conductors comprising an electrically-inert center and an elongated conductive wire spirally and interstitially wound around said center for substantially the full length thereof so as to provide a continuous electrical path for electrically-communicating said ignition pulses between said first and said second terminal contacts, (iii) each of said ignition conductors being generally-helically twisted about each other so as to provide at least repeated electrical contacts of the elongated conductive wire of each with each other along the respective lengths of each, whereby electrical continuity between said terminal contacts may be maintained despite the occurrence of one or more electrical discontinuities along the elongated conductive wire of one or more of said ignition conductors, (iv) at least one of said ignition conductors being at least partially coated with an electrically-conductible coating; and (d) a translucent flexible insulating medium electrically insulating the outer exposed surfaces of the twisted ignition conductors substantially the full length thereof between said first and said second terminal contacts to form a unitary ignition system cable.

14. The ignition system cable of claim 13, wherein said electrically-conductible coating comprises a conductive latex.

15. The ignition system cable of claim 13, wherein the electrically-inert centers of said ignition conductors comprises elongated strands of glass fibers and Kevlar fibers.

16. The ignition system cable of claim 13, wherein said elongated conductive wire comprises stainless steel wire.

17. The ignition system cable of claim 13, wherein said flexible insulating medium comprises EPDM.

18. The ignition system cable of claim 13, wherein said flexible insulating medium comprises silicon rubber.

19. The ignition system of claim 13, including a concentric reenforcing braid intermediate said ignition conductors and the exposed surface of said ignition system cable.

20. The ignition system of claim 13 wherein said reenforcing braid comprises braided fiberglass.

* * * * *